US010930215B2

(12) United States Patent
Xu

(10) Patent No.: US 10,930,215 B2
(45) Date of Patent: Feb. 23, 2021

(54) PIXEL CIRCUIT, DRIVING METHOD THEREOF, AND DISPLAY APPARATUS

(71) Applicant: BOE TECHNOLOGY GROUP CO., LTD., Beijing (CN)

(72) Inventor: Pan Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 126 days.

(21) Appl. No.: 15/842,927

(22) Filed: Dec. 15, 2017

(65) Prior Publication Data

US 2018/0308430 A1 Oct. 25, 2018

(30) Foreign Application Priority Data

Apr. 25, 2017 (CN) ..... 2017 1 0278367

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01); *G09G 2310/0281* (2013.01); *G09G 2320/029* (2013.01); *G09G 2320/0233* (2013.01); *G09G 2320/0295* (2013.01)

(58) Field of Classification Search
CPC ..... G09G 3/3233; G09G 3/3258; G09G 2300/0819; G09G 2310/0281; G09G 2320/0233; G09G 2320/029; G09G 2320/0295
See application file for complete search history.

(56) References Cited

U.S. PATENT DOCUMENTS

| | | | |
|---|---|---|---|
| 9,147,619 | B2 | 9/2015 | Lee |
| 2009/0184903 | A1 | 7/2009 | Kwon |
| 2011/0050674 | A1 | 3/2011 | Kim |
| 2014/0347253 | A1 | 11/2014 | Lee |

(Continued)

FOREIGN PATENT DOCUMENTS

| | | | |
|---|---|---|---|
| CN | 101488319 | A | 7/2009 |
| CN | 104183212 | A | 12/2014 |

(Continued)

OTHER PUBLICATIONS

First Office Action for Chinese Patent Application No. 201710278367.3 dated Oct. 15, 2018.

(Continued)

*Primary Examiner* — Bryan Earles
(74) *Attorney, Agent, or Firm* — Calfee, Halter & Griswold LLP

(57) ABSTRACT

A pixel circuit is disclosed which includes a plurality of sub-pixel circuits each including: an organic light emitting diode having an anode; a driving transistor connected in series with the organic light emitting diode via the anode; and a sensing transistor having a first electrode connected to the anode, a gate connected to a first scan line, and a second electrode. The pixel circuit further includes a common transistor having a first electrode connected to the second electrodes of the sensing transistors of the plurality of sub-pixel circuits, a gate connected to the first scan line, and a second electrode connected to a sensing line. Also disclosed is a display apparatus including the pixel circuit and a method of driving the pixel circuit.

20 Claims, 5 Drawing Sheets

(56) References Cited

U.S. PATENT DOCUMENTS

| | | | |
|---|---|---|---|
| 2015/0145845 | A1 | 5/2015 | Nam et al. |
| 2015/0170565 | A1 | 6/2015 | Hong et al. |
| 2016/0189614 | A1 | 6/2016 | Tani et al. |
| 2016/0351096 | A1 | 12/2016 | Tani et al. |
| 2017/0004765 | A1 | 1/2017 | Tani et al. |
| 2018/0211593 | A1 | 7/2018 | Zhang |
| 2019/0164462 | A1 | 5/2019 | Chen |

FOREIGN PATENT DOCUMENTS

| | | | |
|---|---|---|---|
| CN | 104658476 | A | 5/2015 |
| CN | 104715717 | A | 6/2015 |
| CN | 105741784 | A | 7/2016 |
| CN | 106023893 | A | 10/2016 |
| CN | 106205496 | A | 12/2016 |
| CN | 106328052 | A | 1/2017 |
| CN | 106486064 | A | 3/2017 |

OTHER PUBLICATIONS

Second Office Action for Chinese Patent Application No. 201710278367.3 dated Jul. 4, 2019.

PIXEL CIRCUIT, DRIVING METHOD THEREOF, AND DISPLAY APPARATUS

CROSS REFERENCE TO RELATED APPLICATIONS

This application claims the benefit of Chinese Patent Application No. 201710278367.3 filed on Apr. 25, 2017, the entire disclosure of which is incorporated herein by reference.

TECHNICAL FIELD

The present disclosure relates to the field of display technology, and particularly to a pixel circuit, a driving method thereof, and a display apparatus.

BACKGROUND

In an active matrix organic light emitting diode (AMOLED) display, respective driving transistors in the pixels may have different characteristics (e.g., different mobility or threshold voltages) such that the pixels exhibit different brightnesses at the same grayscale voltage. Such a non-uniformity of the brightness is known as "mura". Various compensation techniques may be used to mitigate the mura effect, among which external electrical compensation is commonly used, especially in large-size OLED displays. The external electrical compensation may involve the use of a sensing line to draw a saturation current (hereinafter also referred to as a "pixel current") generated by the driving transistor to an external compensation circuit, which external compensation circuit then determines compensation data based on a difference between the magnitude of the pixel current and a target value, and provides the driving circuit with compensated display data corresponding to a target brightness.

The pixel current drawn from the pixel by the sensing line can be indicated by a voltage generated by the pixel current charging a capacitance present on the sensing line. Thus, the total capacitance present on the sensing line is one of the factors that affect the accuracy of the compensation. The larger the total capacitance, the greater the required charging current and the longer the charging time. A large charging current means a large data voltage, which may exceed a normal range for the display voltage. Moreover, a long charging time may not be satisfied in some scenarios where real-time compensation is required, resulting in insufficient charging of the capacitor and thus reduced compensation accuracy.

SUMMARY

It would be advantageous to provide a pixel circuit which may alleviate or mitigate at least one of the above problems. It would also be desirable to provide a display apparatus including such a pixel circuit and a method of driving such a pixel circuit.

According to a first aspect of the present disclosure, a pixel circuit is provided which comprises: a plurality of sub-pixel circuits each comprising: an organic light emitting diode having an anode; a driving transistor connected in series with the organic light emitting diode via the anode; and a sensing transistor having a first electrode connected to the anode, a gate connected to a first scan line, and a second electrode; and a common transistor having a first electrode connected to the second electrodes of the sensing transistors of the plurality of sub-pixel circuits, a gate connected to the first scan line, and a second electrode connected to a sensing line.

In certain exemplary embodiments, the plurality of sub-pixel circuits are configured such that the driving transistor of one of the plurality of sub-pixel circuits generates a pixel current based on a data voltage when the sub-pixel circuit is supplied with the data voltage in a compensation mode. The sensing transistors and the common transistor of the sub-pixel circuit to which the data voltage is supplied are configured to transfer the generated pixel current to the sensing line for detection in response to a first scan signal from the first scan line in the compensation mode.

In certain exemplary embodiments, each of the plurality of sub-pixel circuits further comprises: a storage capacitor having a first terminal connected to a gate of the driving transistor and a second terminal connected to a source of the driving transistor; and a switching transistor having a first electrode connected to the data line, a gate connected to a second scan line, and a second electrode connected to the first terminal of the storage capacitor.

In certain exemplary embodiments, the driving transistor is an N-type transistor, and the source of the driving transistor and the second terminal of the storage capacitor are connected to the anode of the organic light emitting diode.

In certain exemplary embodiments, the sensing transistors of the plurality of sub-pixel circuits and the common transistor are configured to transfer a reference voltage to the second terminals of the storage capacitors of the plurality of sub-pixel circuits in response to the first scan signal from the first scan signal line when the reference voltage is applied to the sensing line.

In certain exemplary embodiments, the driving transistor is a P-type transistor, and a drain of the driving transistor and the second terminal of the storage capacitor are connected to the anode of the organic light emitting diode.

In certain exemplary embodiments, the common transistor is a bottom-gate transistor.

In certain exemplary embodiments, the pixel circuit comprises four sub-pixel circuits for a RGBW pixel pattern or three sub-pixel circuits for a RGB pixel pattern.

According to a second aspect of the present disclosure, a display apparatus is provided which comprises: a first scan driver for sequentially supplying a first scan signal to a plurality of first scan lines; a second scan driver for sequentially supplying a second scan signal to a plurality of second scan lines; a data driver for generating data signals based on image data and supplying the generated data signals to a plurality of data lines; and a plurality of pixel circuits each comprising a plurality of sub-pixel circuits. The plurality of pixel circuits is arranged in an array such that the sub-pixel circuits of the plurality of pixel circuits are arranged in rows and columns. Each row of sub-pixel circuits is connected to a respective one of the plurality of first scan lines and a respective one of the plurality of second scan lines. Each column of sub-pixel circuits is connected to a respective one of the plurality of data lines. Each of the plurality of sub-pixel circuits comprises: an organic light emitting diode having an anode; a driving transistor connected in series with the organic light emitting diode via the anode; and a sensing transistor having a first electrode connected to the anode, a gate connected to the first scan line to which the row of sub-pixel circuits is connected, and a second electrodes. Each column of pixel circuits is connected to a respective one of the plurality of sensing lines. Each of the plurality of pixel circuits further comprises a common transistor having a first electrode connected to the second electrodes of the sensing transistors of the plurality of sub-pixel circuits, a gate connected to the first scan line to which the row of sub-pixel circuits is connected, and a second electrode connected to the sensing line to which the column of pixel circuits is connected. The display apparatus further comprises: a plurality of sampling circuits each connected to a respective one of the plurality of sensing lines, each of the sampling circuits being configured to sample a voltage generated by the pixel current transferred by the respective sensing line charging a capacitance present on the sensing line; and a timing controller for controlling operations of the first scan driver, the second scan driver, the data driver, and the plurality of sampling circuits and compensating the image data provided to the data driver based on the sampling by the plurality of sampling circuits.

In certain exemplary embodiments, each of the plurality of sampling circuits comprises a first controlled switch and an analog-to-digital converter. The first controlled switch is configured to couple the generated voltage to the analog-to-digital converter in response to a first switch control signal. The analog-to-digital converter is configured to convert the generated voltage into a digital value and provide the digital value to the timing controller.

In certain exemplary embodiments, the driving transistor is an N-type transistor, and each of the plurality of sampling circuits further comprises a second controlled switch configured to apply a reference voltage supplied by a reference voltage source to the sensing line in response to a second switch control signal.

In certain exemplary embodiments, the sensing transistors of the plurality of sub-pixel circuits and the common transistor of each of the pixel circuits are configured to transfer the reference voltage to the first electrodes of the sensing transistors in response to the first scan signal from the first scan line when the reference voltage is applied to the sensing line.

In certain exemplary embodiments, each of the plurality of sub-pixel circuits of each of the pixel circuits further comprises: a storage capacitor having a first terminal connected to a gate of the driving transistor and a second terminal connected to a source of the driving transistor; and a switching transistor having a first electrode connected to the data line to which the column of sub-pixel circuits is connected, a gate connected to the second scan line to which the row of sub-pixel circuits is connected, and a second electrode connected to the first terminal of the storage capacitor.

In certain exemplary embodiments, the driving transistor is an N-type transistor, and the source of the driving transistor and the second terminal of the storage capacitor are connected to the anode of the organic light emitting diode.

In certain exemplary embodiments, the driving transistor is a P-type transistor, and wherein a drain of the driving transistor and the second terminal of the storage capacitor are connected to the anode of the organic light emitting diode.

In certain exemplary embodiments, the common transistor is a bottom-gate type transistor.

In certain exemplary embodiments, the pixel circuit comprises four sub-pixel circuits for a RGBW pixel pattern or three sub-pixel circuits for a RGB pixel pattern.

According to a third aspect of the present disclosure, a method of driving a pixel circuit is provided. The pixel circuit comprises a plurality of sub-pixel circuits and a common transistor. Each of the plurality of sub-pixel circuits comprises: an organic light emitting diode having an anode; a driving transistor connected in series with the organic light emitting diode via the anode; a sensing transistor having a first electrode connected to the anode, a gate connected to a first scan line, and a second electrode; a storage capacitor having a first terminal connected to a gate of the driving transistor and a second terminal connected to a source of the driving transistor; and a switching transistor having a first electrode connected to a data line, a gate connected to a second scan line, and a second electrode connected to the first terminal of the storage capacitor. The common transistor have a first electrode connected to the second electrodes of the plurality of sub-pixel circuits, a gate connected to the first scan line, and a second electrode connected to a sensing line. The method comprises: simultaneously with supplying a data signal to one of respective data lines connected to the plurality of sub-pixel circuits, applying a second scan signal from the second scan line to the gates of the switching transistors of the plurality of sub-pixel circuits so as to transfer the data signal from the data line to the first terminal of the storage capacitor of the sub-pixel circuit to which the data line is connected; transferring a pixel current generated by the driving transistor of the sub-pixel circuit based on the data signal to the sense line by applying a first scan signal from the first scan line to the gates of the sensing transistors of the plurality of sub-pixel circuits and the gate of the common transistor, wherein the pixel current charges a capacitance present on the sense line; and transferring via the sensing line a voltage generated by the pixel current charging the capacitance to an external circuit for detection.

In certain exemplary embodiments, the driving transistor is an N-type transistor, and the source of the driving transistor and the second terminal of the storage capacitor are connected to the anode of the organic light emitting diode. The method further comprises simultaneously with applying the second scan signal to the gates of the switching transistors, transferring a reference voltage applied to the sensing line to the second terminal of the storage capacitor of the sub-pixel circuit by applying the first scan signal to the gates of the sensing transistors of the plurality of sub-pixel circuits and the gate of the common transistor.

In certain exemplary embodiments, the method further comprises simultaneously with transferring the pixel current to the sensing line, deactivating the second scan signal to turn off the switching transistor.

In certain exemplary embodiments, the method further comprises simultaneously with transferring the pixel current to the sensing line, maintaining the second scan signal active to continuously apply the data signal to the first terminal of the storage capacitor.

These and other aspects of the present disclosure will be apparent from and elucidated with reference to the embodiment(s) described hereinafter.

DETAILED DESCRIPTION

It will be understood that, although the terms first, second, third etc. may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element is referred to as being "connected to" or "coupled to" another element, it can be directly connected or coupled to the other element, or intervening elements may be present. In contrast, when an element is referred to as being "directly connected to" or "directly coupled to" another element, there are no intervening elements present. In addition, the phrase "based on" is intended to be construed as "based at least in part on", unless otherwise indicated clearly.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 1:
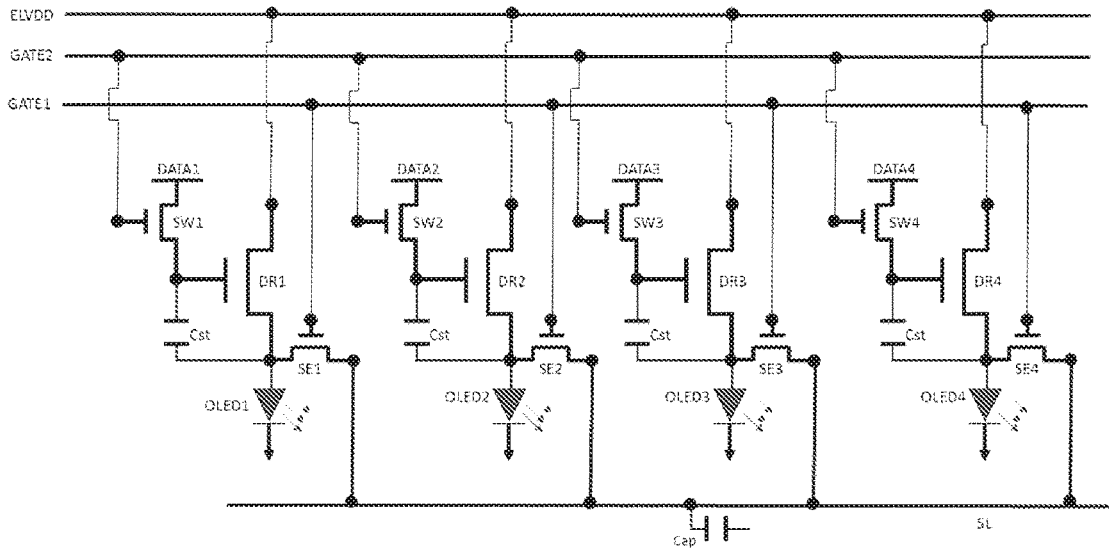
(RELATED ART) FIG. 1
FIG. 1 shows a schematic diagram of a typical OLED pixel circuit in which external electrical compensation can be implemented.

FIG. 1 shows a schematic diagram of a typical OLED pixel circuit in which external electrical compensation can be achieved. As shown, the pixel circuit includes four sub-pixel circuits including respective switching transistors SW1, SW2, SW3, and SW4, respective driving transistors DR1, DR2, DR3, and DR4, respective sensing transistors SE1, SE2, SE3, and SE4, respective storage capacitor Cst, and respective organic light emitting diodes OLED1, OLED2, OLED3, and OLED4. The switching transistors SW1, SW2, SW3 and SW4 are connected to data lines DATA1, DATA2, DATA3 and DATA4, respectively, and operate under the control of a scan signal from a second scan line GATE2. The driving transistors DR1, DR2, DR3 and DR4 are connected to a power supply line ELVDD. The sensing transistors SE1, SE2, SE3 and SE4 operate under the control of a scan signal from a first scan line GATE1. In order for an increased the aperture ratio, the four sensing transistors SE1, SE2, SE3 and SE4 (and potentially the sensing transistors of more pixel circuits) are connected to a common sensing line SL. In this case, a capacitance Cap present on the sensing line SL includes at least 1) a capacitance formed by the overlapping of the sensing line SL with other metal wires or metal blocks, and 2) a parasitic capacitance (e.g., a gate-source/gate-drain capacitance) of the sensing transistors SE1, SE2, SE3 and SE4 connected to the sensing line SL. Especially, in the case where the sensing transistors SE1, SE2, SE3 and SE4 have a bottom-gate structure, the parasitic gate-source capacitance and gate-drain capacitance are relatively large as compared with the case where the sensing transistors have a top-gate structure.

Figure 2:
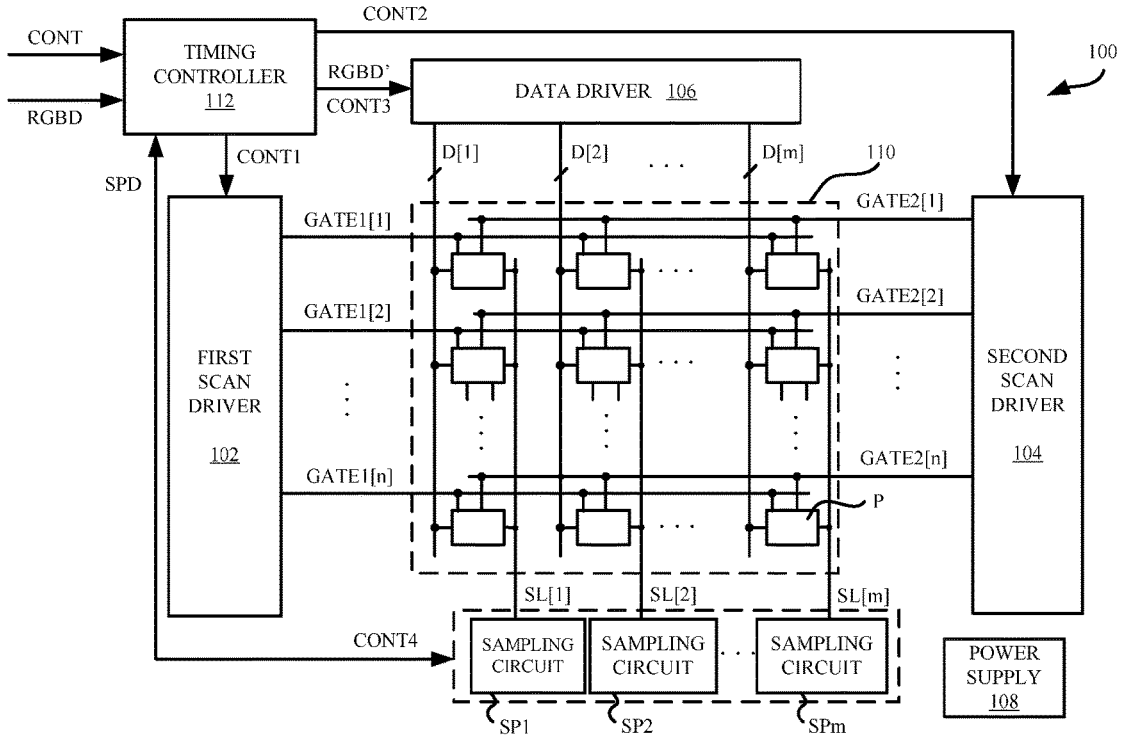
FIG. 2 shows a block diagram of a display apparatus according to an embodiment of the present disclosure.

FIG. 2 shows a block diagram of a display apparatus 100 according to an embodiment of the present disclosure. Referring to FIG. 2, the display apparatus 100 includes a pixel array 110, a first scan driver 102, a second scan driver 104, a data driver 106, a plurality of sampling circuits SP1, SP2, . . . , SPm, a power supply 108, and a timing controller 112.

The pixel array 110 includes n×m pixel circuits P. Each pixel circuit P includes an OLED and a plurality of sub-pixel circuits (not shown in FIG. 2). The pixel array 110 includes n first scan lines GATE1[1], GATE1[2] . . . , GATE1[n] arranged in a row direction to transfer a first scan signal; n second scan lines GATE2[1], GATE2[2] . . . , GATE2[n] arranged in the row direction to transfer a second scan signal; m groups of data lines D[1], D[2] D[m] arranged in a column direction to transfer data signals; m sensing lines SL[1], SL[2] . . . , SL[m] arranged in the column direction to draw pixel currents from the pixel circuits P; and electric wires (not shown) to which a power supply voltage ELVDD is applied. n and m are natural numbers. Depending on the number of the sub-pixel circuits included in each pixel circuit P, each of the groups of data lines D[1], D[2] . . . , D[m] may include the same number of data lines as the number of the sub-pixel circuits so as to supply the sub-pixel circuits with respective data signals. The n×m pixel circuits P are arranged in an array so that the sub-pixel circuits of the pixel circuits P are arranged in rows and columns. Each row of sub-pixel circuits is connected to a respective one of the n first scan lines and a respective one of the n second scan lines, and each column of sub-pixel circuits is connected to a respective one of the data lines. In addition, each column of pixel circuits P is connected to a respective one of the sensing lines SL[1], SL[2] . . . , SL[m].

The first scan driver 102 is connected to the first scan lines GATE1[1], GATE1[2] . . . , GATE1[n] to apply the first scan signal to the pixel array 110. The second scan driver 104 is connected to the second scan lines GATE2[1], GATE2[2], . . . , GATE2[n] to apply the second scan signal to the pixel array 110. The data driver 106 is connected to the groups of data lines D[1], D[2] . . . , D[m] to apply the data signals to the pixel array 110. The sampling circuits SP1, SP2, . . . , SPm are connected to the sensing lines SL[1], SL[2] . . . , SL[m], respectively, so as to sample the voltages generated by the pixel currents drawn from the pixel circuits P charging the capacitances present on the sensing lines SL[1], SL[2] . . . , SL[m]. The power supply voltage ELVDD (not shown in FIG. 2) supplied by the power supply 108 is applied to each of the pixel circuits P in the pixel array 110.

The timing controller 112 is used to control the operations of the first scan driver 102, the second scan driver 104, the data driver 106, and the sampling circuits SP1, SP2 . . . , SPm. The timing controller 112 receives input image data RGBD and an input control signal CONT from an external device (e.g., a host) and receives sampling data SPD from the sampling circuits SP1, SP2 . . . , SPm. The input image data RGBD may include a plurality of input pixel data for a plurality of pixels. Each of the input pixel data may include red grayscale data R, green grayscale data G, and blue grayscale data B for a respective one of the plurality of pixels. The input control signal CONT may include a main clock signal, a data enable signal, a vertical synchronization signal, a horizontal synchronization signal, and so on. The timing controller 112 also receives sampled data SPD from the sampling circuits SP1, SP2 . . . , SPm. The timing controller 112 generates output image data RGBD', a first control signal CONT1, a second control signal CONT2, a third control signal CONT3, and a fourth control signal CONT4 based on the input image data RGBD, the sampling data SPD, and the input control signal CONT.

Specifically, the timing controller 112 may generate the output image data RGBD' based on the input image data RGBD and the sampling data SPD. The output image data RGBD' may be compensated image data that is generated by compensating the input image data RGBD using a compensation algorithm. The specific compensation algorithm is beyond the scope discussed herein and may be any known or future technology in the art. The output image data RGBD' may include a plurality of output pixel data for a plurality of pixels and is provided to the data driver 106. The timing controller 112 may generate the first control signal CONT1 and the second control signal CONT2 based on the input control signal CONT. The first control signal CONT1 and the second control signal CONT2 may be supplied to the first scan driver 102 and the second scan driver 104, respectively, and the drive timings of the first scan driver 102 and the second scan driver 104 may be controlled based on the first control signal CONT1 and the second control signal CONT2. The first control signal CONT1 and the second control signal CONT2 may include a vertical start signal, a gate clock signal, and so on. The timing controller 112 may also generate the third control signal CONT3 and the fourth control signal CONT4 based on the input control signal CONT. The third control signal CONT3 may be provided to the data driver 106, and the drive timing of the data driver 106 may be controlled based on the third control signal CONT3. The third control signal CONT3 may include a horizontal start signal, a data clock signal, a data load signal, a polarity control signal, and so on. The fourth control signal CONT4 may be supplied to the sampling circuits SP1, SP2, . . . , SPm, and the driving timings of the sampling circuits SP1, SP2, . . . , SPm may be controlled based on the fourth control signal CONT4. For example, the sampling circuits SP1, SP2, . . . , SPm may be controlled such that they sample the voltages of the capacitances present on the sensing lines SL[1], SL[2], . . . , SL[m] after completion of the charging of the capacitances by the pixel currents in the compensation mode.

The first scan driver 102 and the second scan driver 104 receive from the timing controller 112 the first control signal CONT1 and the second control signal CONT2, respectively. The first scan driver 102 generates a plurality of gate signals that are sequentially applied to the first scan lines GATE1[1], GATE1[2], . . . , GATE1[n] based on the first control signal CONT1. The second scan driver 104 generates a plurality of gate signals that are sequentially applied to the second scan lines GATE2[1], GATE2[2], . . . , GATE2[n] based on the second control signal CONT2.

The data driver 106 receives the third control signal CONT3 and the output image data RGBD' from the timing controller 112. The data driver 106 generates a plurality of data signals (e.g., analog grayscale voltages) based on the third control signal CONT3 and the output image data RGBD' (e.g., digital image data). The data driver 106 may apply the plurality of data signals to respective data lines of the groups of data lines D[1], D[2], . . . , D[m].

The sampling circuits SP1, SP2, . . . , SPm are connected to respective sensing lines SL[1], SL[2], . . . , SL[m] and receive the fourth control signal CONT4 from the timing controller 112. Each of the sampling circuits SP1, SP2, . . . , SPm samples the voltage generated by the pixel current transferred by a respective sensing line charging the capacitance present on the sensing line based on the fourth control signal CONT4. Given the value of the capacitance and the charging time, the generated voltage may be indicative of the magnitude of the pixel current.

Figure 3:
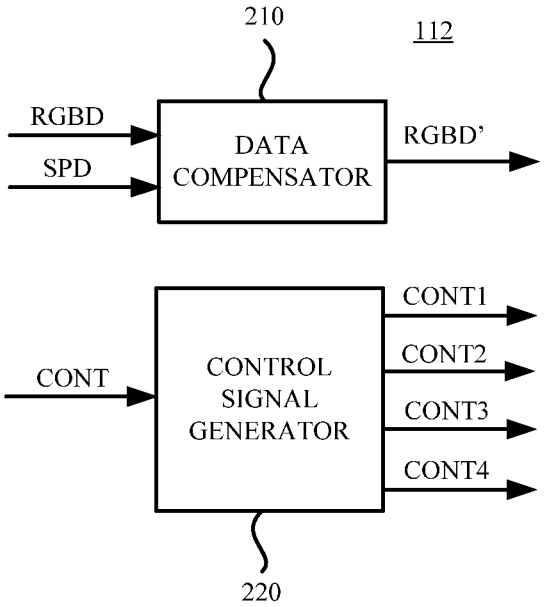
FIG. 3 shows a block diagram of a timing controller included in the display apparatus of FIG. 2.

FIG. 3 shows a block diagram of the timing controller 112 included in the display apparatus 100 of FIG. 2.

Referring to FIG. 3, the timing controller 112 may include a data compensator 210 and a control signal generator 220. For ease of description, the timing controller 112 is shown in FIG. 3 as being divided into two elements, although the timing controller 112 may not be physically divided.

The data compensator 210 may compensate the input image data RGBD based on the sampled data SPD from the plurality of sampling circuits SP1, SP2, . . . , SPm to generate the compensated output image data RGBD'.

The control signal generator 220 may receive the input control signal CONT from the external device and may generate the control signals CONT1, CONT2, CONT3 and CONT4 for use in FIG. 2 based on the input control signal CONT. The control signal generator 220 may output the first control signal CONT1 to the first scan driver 102 in FIG. 2, the second control signal CONT2 to the second scan driver 104 in FIG. 2, the third control signal CONT3 to the data driver 106 in FIG. 2, and the fourth control signal CONT4 to the sampling circuits SP1, SP2, . . . , SPm in FIG. 2.

By way of example, and not limitation, in the above embodiments, the display apparatus 100 may be any product or component having a display function, such as a mobile phone, a tablet computer, a television set, a display, a notebook computer, a digital photo frame, a navigator, and the like.

Figure 4:
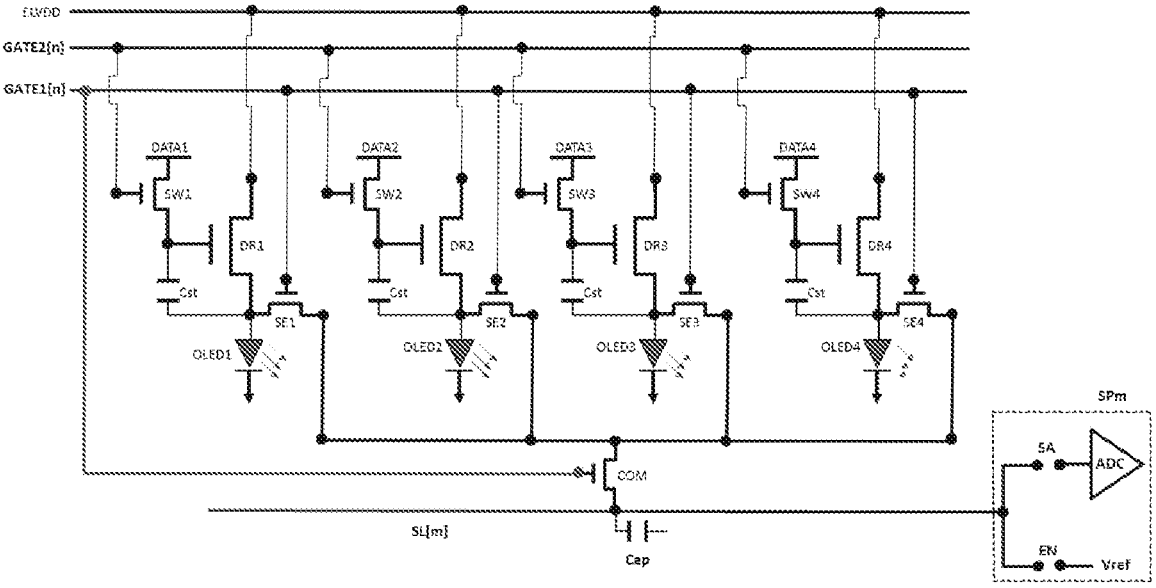
FIG. 4 shows a circuit diagram of a pixel circuit according to an embodiment of the present disclosure.

FIG. 4 shows a circuit diagram of a pixel circuit according to an embodiment of the present disclosure. For ease of description, the pixel circuit connected to the first scan line GATE1[n], the n-th second scan line GATE2[n], the m-th group of data lines D[m], and the m-th sensing line SL[m] is shown.

In the example of FIG. 4, the pixel circuit includes four sub-pixel circuits including respective organic light emitting diodes OLED1, OLED2, OLED3, and OLED4, respective driving transistors DR1, DR2, DR3, and DR4, and respective sensing transistors SE1, SE2, SE3, and SE4. The group of data lines connected to the pixel circuit includes four data lines DATA1, DATA2, DATA3 and DATA4, which supply the data signals to the four sub-pixel circuits, respectively. The four sub-pixel circuits may be designed to have the same structure and yet display different color components (e.g., for a RGBW pixel pattern). Taking the first sub-pixel circuit as an example, the driving transistor DR1 is connected in series with the organic light emitting diode OLED1 via an anode of the organic light emitting diode OLED1, and the sensing transistor SE1 has a first electrode connected to the anode, a gate connected to the first scan line GATE1[n], and a second electrode. This sub-pixel circuit further includes a storage capacitor Cst and a switching transistor SW1. The storage capacitor Cst has a first terminal connected to the gate of the driving transistor DR1 and a second terminal connected to the source of the driving transistor DR1. The switching transistor SW1 has a first electrode connected to the data line DATA1, a gate connected to the second scan line GATE2[n], and a second electrode connected to the first terminal of the storage capacitor Cst. The switching transistor SW1 may transfer the data signal from the data line DATA1 to the first terminal of the storage capacitor Cst in response to a second scan signal from the second scan line GATE2[n].

The pixel circuit further includes a common transistor COM which has a first electrode connected to the second electrodes of the sensing transistors SE1, SE2, SE3, SE4 of the sub-pixel circuits, a gate connected to the first scan line GATE1[n], and a second electrode connected to the sensing line SL[m]. The sub-pixel circuits are configured such that when one of the sub-pixel circuits is supplied with a data voltage in the compensation mode the driving transistor of the sub-pixel circuit generates a saturation current based on the data voltage. The sensing transistor and the common transistor COM of the sub-pixel circuit to which the data voltage is supplied are configured to transfer the generated saturation current to the sensing line SL[m] for detection in response to a first scan signal from the first scan line GATE1[n] in the compensation mode.

As shown in FIG. 4, instead of being directly connected to the sensing transistors SE1, SE2, SE3 and SE4 of the sub-pixel circuits, the sensing line SL[m] is connected to the sub-pixel circuits via the common transistor COM. Thus, the capacitance Cap present on the sensing line SL[m] includes 1) a capacitance formed by the overlapping of the sensing line SL[m] with other metal wires or metal blocks, and 2) a parasitic capacitance of the common transistor COM. For the parasitic capacitance, the parasitic capacitances of all the common transistors COM of a column of pixels connected to the sensing line SL[m] are taken into account, and the total parasitic capacitance can be simply calculated as 1×Cp×Nr, where Cp is the parasitic capacitance (the gate-source capacitance or gate-drain capacitance) of a single transistor, and Nr is the number of pixels in the pixel array. In contrast, in the case of the pixel circuit as shown in FIG. 1, the total parasitic capacitance present on the sensing line SL is 4×Cp×Nr because the sensing line SL is connected to the four sensing transistors SE1, SE2, SE3 and SE4.

Since the number of the transistors connected to the sensing line is greatly reduced in the pixel circuit according to the present embodiment, the capacitance present on the sensing line can be greatly reduced. This is advantageous for improving the accuracy of external electrical compensation. In addition, there is no need to add new control logic since the gate signal for driving the common transistor COM may be the same as the gate signal (i.e., the first scan signal from the first scan line GATE1[n]) for driving the sensing transistors SE1, SE2, SE3, SE4. This may result in a low complexity of the circuit.

In various embodiments, the common transistor COM (and possibly other transistors) in the pixel circuit may be a bottom-gate transistor. Although the bottom-gate transistor has a larger parasitic capacitance than the top-gate type transistor, the capacitance present on the sensing line can still be small in the pixel circuit according to the present embodiment because the sensing line is connected via a single common transistor to the sub-pixel circuits, rather than directly connected to a plurality of sensing transistors of the sub-pixel circuits. Other embodiments are also contemplated. For example, the common transistor COM (and possibly other transistors) in the pixel circuit may be a top-gate type transistor.

Continuing with the example of FIG. 4, the sensing line SL[m] is connected to a sampling circuit SPm which samples a voltage generated by the saturation current transferred via the sensing transistors SE1, SE2, SE3 or SE4 and the common transistor COM charging the capacitor Cap. The sampling circuit SPm includes a first controlled switch SA and an analog-to-digital converter ADC. The first controlled switch SA may couple the generated voltage to the analog-to-digital converter ADC in response to a first switch control signal. The analog-to-digital converter ADC may convert the generated voltage into a digital value and provide the digital value to the timing controller 112 in FIG. 2.

In the example of FIG. 4, the driving transistors DR1, DR2, DR3, DR4 in the pixel circuit are shown as N-type transistors. In this case, the sources of the driving transistors DR1, DR2, DR3, DR4 and the second terminals of the respective storage capacitors Cst are connected to the respective anodes of the organic light emitting diodes OLED1, OLED2, OLED3, OLED4, and the sampling circuit SPm further includes a second controlled switch EN operable to apply a reference voltage supplied from a reference voltage source Vref to the sensing line SL[m] in response to a second switch control signal. As described below, when the data voltage is to be written into the sub-pixel circuit, the reference voltage can be coupled to the second terminals of the respective storage capacitors Cst through the common transistor COM and the respective sensing transistors SE1, SE2, SE3, SE4. The reference voltage coupled to the second terminal of the storage capacitor Cst, together with the data signal coupled to the first terminal of the storage capacitor Cst, determines the data voltage stored by the storage capacitor Cst (i.e., the voltage across the gate and source of the driving transistors DR1, DR2, DR3, or DR4).

The operations of the pixel circuit of FIG. 4 is described below with reference to FIGS. 5-7, wherein FIG. 5 relates to the operations of the pixel circuit in the light emission mode, and FIGS. 6 and 7 relate to the operations of the pixel circuit in the compensation mode.

Figure 5:
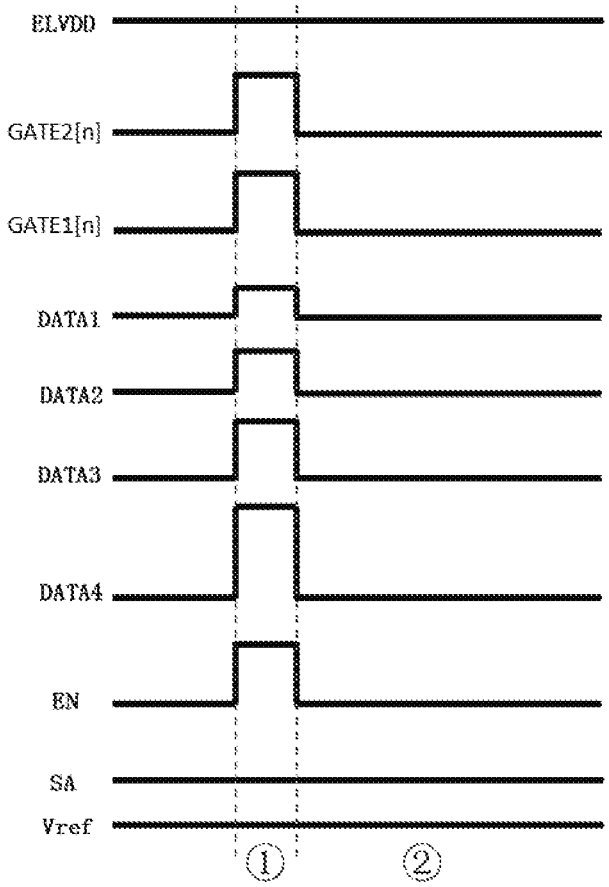
FIG. 5 is a timing diagram of the pixel circuit of FIG. 4 in a light emission mode.

FIG. 5 is a timing diagram of the pixel circuit of FIG. 4 in the light emission mode.

In phase ①, respective data voltages are written into the storage capacitors Cst. The second scan signal (in FIG. 5 a high level voltage) from the second scan line GATE2[n] is applied to the gates of the switching transistors SW1, SW2, SW3 and SW4 such that the data signals on the data lines DATA1, DATA2, DATA3 and DATA4 are transferred to the first terminals of the storage capacitors Cst. The first scan signal (in FIG. 5 a high level voltage) from the first scan line GATE1[n] is applied to the gates of the sensing transistors SE1, SE2, SE3, SE4 and the common transistor COM, and the second switch control (in FIG. 5 a high level voltage) is applied to the second controlled switch EN so that the reference voltage supplied from the reference voltage source Vref is applied to the sensing line SL[m], and then transferred to the second terminals of the respective storage capacitors Cst through the common transistor COM and the respective sensing transistors SE1, SE2, SE3, SE4. As a result, respective data voltages are stored in the storage capacitors Cst.

In phase ②, the driving transistors DR1, DR2, DR3, DR4 drive the respective organic light emitting diodes OLED1, OLED2, OLED3, OLED4 to emit light. According to the saturation current formula of the transistor, the pixel current generated by the driving transistor can be calculated as:

$$I=\tfrac{1}{2}*u*\mathrm{Cox}*(W/L)(Vgs-Vth)^2 \quad (1)$$

where u is the mobility of electrons, Cox is the capacitance of the gate oxide layer per unit area, W/L is the channel length to width of the driving transistor, Vgs is the voltage across the gate and source of the driving transistor, and Vth is the threshold voltage of the driving transistor. As the first scan signal on the first scan line GATE1[n] is deactivated in phase ② (which transitions to a low level as shown in FIG. 5), the sensing transistors SE1, SE2, SE3, SE4 and common transistor COM are turned off. Thus, the pixel currents generated by the driving transistors DR1, DR2, DR3, DR4 flow through the respective organic light emitting diodes OLED1, OLED2, OLED3, OLED4, without being drawn to the sensing line SL[m].

Figure 6:
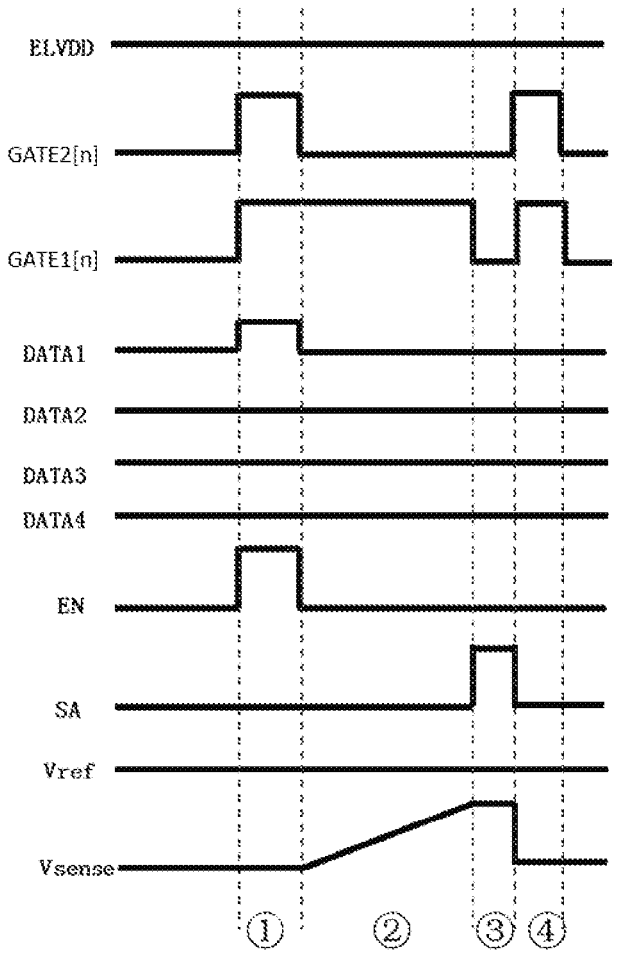
FIG. 6 is a timing diagram of the pixel circuit of FIG. 4 in a compensation mode.

FIG. 6 is a timing diagram of the pixel circuit of FIG. 4 in the compensation mode.

In phase ①, a data voltage is written into one of the plurality of sub-pixel circuits of the pixel circuit. As shown in FIG. 6, a data signal is supplied to one of the respective data lines (in FIG. 6 DATA1) connected to the plurality of sub-pixel circuits, and the second scan signal from the second scan line GATE2[n] is simultaneously applied to the gates of the switching transistors SW1, SW2, SW3, SW4 of the plurality of sub-pixel circuits. Therefore, the data signal from the data line DATA1 is transferred to the first terminal of the storage capacitor Cst of the sub-pixel circuit connected to the data line DATA1.

In the case where the driving transistor DR1 is an N-type transistor and thus the source of the driving transistor DR1 and the second terminal of the storage capacitor Cst are connected to the anode of the organic light emitting diode OLED1, the reference voltage (e.g., a low level voltage) may be supplied to the second terminals of the storage capacitor Cst in phase ①. As shown in FIG. 6, the second switch control signal is applied to the second controlled switch EN in phase ① so that a reference voltage supplied from the reference voltage source Vref is applied to the sensing line SL[m]. Simultaneously with the application of the second scan signal to the gates of the switching transistors SW1, SW2, SW3, SW4, SE3, SE4, the reference voltage applied to the sensing line SL[m] is transferred to the second terminals of the storage capacitors Cst by applying the first scan signal from the first scan line GATE1[n] to the respective sensing transistors SE1 SE2, SE3, and SE4. In the example of FIG. 6, the data signal from the data line DATA1 and the reference voltage supplied from the reference voltage source Vref together determine the data voltage stored by the storage capacitor Cst of the first sub-pixel circuit (i.e., the voltage across the gate and source of the driving transistor DR1). The reference voltage in the compensation mode may not be equal to the reference voltage in the light emission mode.

In phase ②, a pixel current is generated by the sub-pixel circuit into which the data voltage is written in phase ① and the pixel current is drawn to the sensing line SL[m] so as to charge the capacitance Cap present on the sensing line SL[m]. In the example of FIG. 6, the driving transistor DR1 generates the pixel current according to the above equation (1). The first scan signal from the first scan line GATE1[n] is applied to the gates of the sensing transistors SE1, SE2, SE3, SE4 and the gate of the common transistor COM so that the sensing transistors SE1, SE2, SE3, SE4 and the common transistor COM are turned on. Therefore, the pixel current generated by the driving transistor DR1 is supplied to the sensing line SL[m] through the sensing transistor SE1 and the common transistor COM, and the capacitance Cap present on the sensing line SL[m] is charged. The voltage Vsense on the capacitance Cap gradually increases during the charging.

In the example of FIG. 6, the second scan signal on the second scan line GATE2[n] is deactivated in phase ② so that the switching transistor SW1 is turned off. Thus, the first terminal of the storage capacitor Cst is floated. In this case, due to a self-boosting effect of the storage capacitor Cst, the voltage across the storage capacitor Cst is maintained at the data voltage written in phase ① even if the voltage Vsense on the capacitor Cap (and thus the voltage at the second terminal of the storage capacitor Cst) gradually increases.

It will be understood that in phase ① the pixel current generated by the driving transistor DR1 does not flow through the organic light emitting diode OLED1, but is transferred to the sensing line SL[m] via the (turned-on) sensing transistor SE1 and common transistor COM. This is because 1) the equivalent resistance of the organic light emitting diode OLED1 is much larger than the equivalent resistance of the turned-on sensing transistor SE1 and common transistor COM, and 2) the voltage Vsense is generally smaller than the threshold voltage of the organic light emitting diode OLED1. Therefore, the pixel current flows along the path of "the driving transistor DR1—the sensing transistor SE1—the common transistor COM—the sensing line SL[m]" without flowing through the organic light emitting diode OLED1.

In phase ③, the charging of the capacitance Cap is completed, and the resultant voltage Vsense is sampled and transferred to an external circuit for detection. Specifically, as shown in FIG. 6, the first scan signal on the first scan line GATE1[n] is deactivated in phase ③ so that the sensing transistors SE1, SE2, SE3, SE4 and the common transistor COM are turned off. At the same time, the first switch control signal (in FIG. 6 a high level voltage) is applied to the first controlled switch SA in the sampling circuit SPm so that the voltage Vsense is coupled to the analog-to-digital converter ADC in the sampling circuit SPm for sampling, and then the sampled digital value is transferred to the external circuit such as the timing controller 112 in FIG. 2. As described above, the voltage Vsense may be indicative of the magnitude of the pixel current. The timing controller 112 may then determine the compensation data based on a difference between the magnitude of the pixel current and a target value and provide the compensated image data corresponding to the target brightness to the data driver 106 in FIG. 2. The specific compensation mechanism is beyond the scope discussed herein.

In phase ④, data signals can be written into the respective sub-pixel circuits via the respective data lines DATA1, DATA2, DATA3 and DATA4. In the example of FIG. 6, the data voltage applied to each sub-pixel circuit (i.e., across the gate and source of the cross-driving transistors DR1, DR2, DR3 or DR4) is set to zero. Other embodiments are also contemplated. For example, the operations shown in FIG. 6 may be performed in a blank period of the frame period, and thus may occur in real time during normal operation of the display apparatus. Specifically, the sampled data acquired in the blank period of the current frame period is used to compensate the image data in the next frame period. In this case, the data voltages for the sub-pixel circuits in the current frame period can be written back to the sub-pixel circuits in phase ④ in order to prevent flickering of the display screen.

Figure 7:
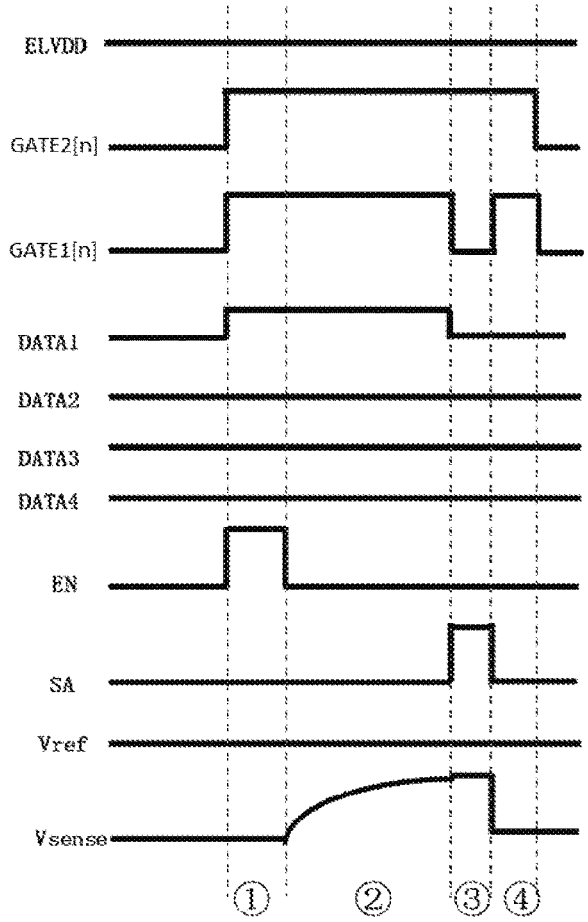
FIG. 7 is a timing diagram of the pixel circuit of FIG. 4 in another compensation mode.

FIG. 7 is a timing diagram of the pixel circuit of FIG. 4 in another compensation mode.

In comparison with the operations shown in FIG. 6, the second scan signal on the second scan line GATE2[n] is held active in phase ② in which the pixel current is transferred to the sensing line SL[m], so as to continuously apply the data signal on the data line DATA1 to the first terminal of the storage capacitor Cst. As the voltage Vsense on the capacitor Cap (and hence the voltage at the second terminal of the storage capacitor Cst) gradually increases, the voltage across the storage capacitor Cst (i.e., the voltage across the gate and source of the driving transistor DR1) decreases, and the pixel current generated by the driving transistor DR1 gradually reduces as well. This results in a decrease in the rate of charging of the capacitance Cap. As such, the voltage Vsense on the capacitance Cap rises slowly at a gradually decreasing slope until the voltage across the storage capacitor Cst is reduced to the threshold voltage of the driving transistor DR1, as shown in FIG. 7. At this time, the driving transistor DR1 is in a critical state between cutoff and saturation, and the generated pixel current can be regarded as equal to zero. The charging of the capacitor Cap is then done.

In the example of FIG. 7, it takes such a long time to charge the capacitance Cap that it may be possible the operations shown in FIG. 7 cannot be performed in real time during normal operation of the display apparatus. Thus, in some embodiments, the operations shown in FIG. 7 may be performed in a state in which the display apparatus is not in a normal operation (e.g., a standby state), although this is not necessary. In this case, the sampled data acquired by performing the operations shown in FIG. 7 may be used to compensate the image data in each frame period when the display apparatus is in normal operation.

In the above embodiments of the pixel circuit, the driving transistors, the switching transistors, the sensing transistors, and the common transistor are shown as N-type transistors. However, the present disclosure is not so limited. In other embodiments at least one of these transistors may be a P-type transistor.

Figure 8:
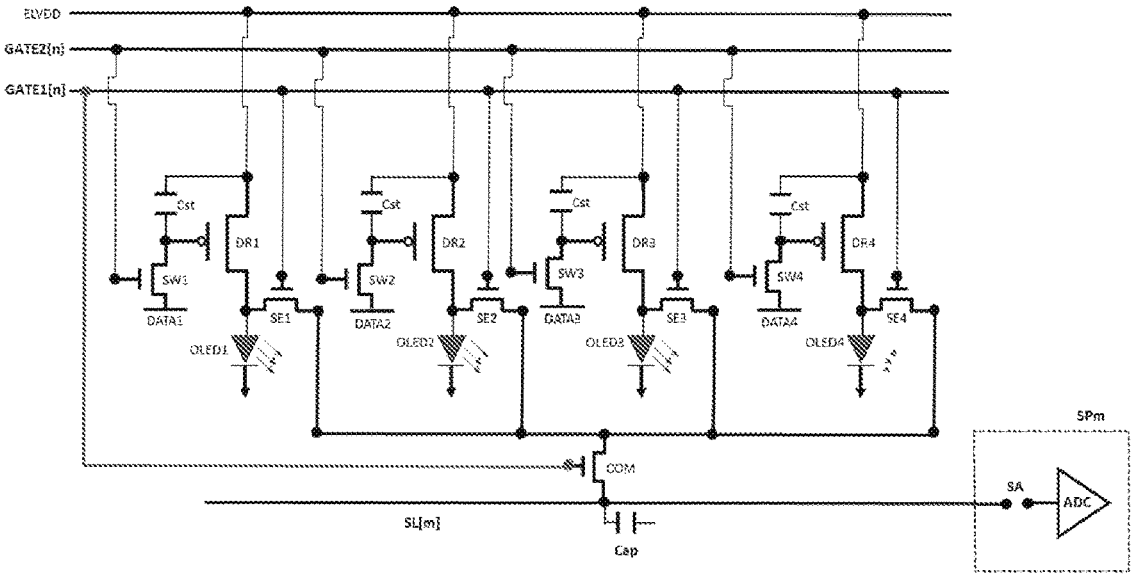
FIG. 8 shows a circuit diagram of a pixel circuit according to another embodiment of the present disclosure.

FIG. 8 shows a circuit diagram of a pixel circuit according to another embodiment of the present disclosure.

As shown in FIG. 8, in this pixel circuit, the driving transistors DR1, DR2, DR3, and DR4 are P-type transistors. The drains of the driving transistors DR1, DR2, DR3, and DR4 are connected to the anodes of the respective organic light emitting diodes OLED1, OLED2, OLED3, and OLED4, and the sources of the driving transistors DR1, DR2, DR3, DR4 and the second terminals of the respective storage capacitors Cst are connected to the supply voltage ELVDD. Since the second terminal of each of the storage capacitor Cst is connected to the fixed power supply voltage ELVDD, it is not necessary to provide a reference voltage to each of the storage capacitors Cst in the data writing phase ①. In this case, the sampling circuit SPm may not be provided with the second controlled switch EN for coupling the reference voltage supplied from the reference voltage source Vref to the sensing line SL[m].

It will be appreciated that the pixel circuit of FIG. 8 is exemplary and that in other embodiments the switching transistors SW1, SW2, SW3, SW4, the sensing transistors SE1, SE2, SE3, SE4 and the common transistor COM may also be P-type transistors. The operation timing for such a pixel circuit needs to be adapted according to the type of the transistors, which is known and therefore is not described in detail herein.

It will also be understood that in the above embodiments although the pixel circuit is shown as including four sub-pixel circuits, the present disclosure is not limited thereto. For example, the pixel circuit may include three sub-pixel circuits for a RGB pixel pattern.

Variations to the disclosed embodiments can be understood and effected by the skilled person in practicing the claimed disclosure, from a study of the drawings, the disclosure, and the appended claims. In the claims, the word "comprises" or "comprising" does not exclude other elements or steps, and the indefinite article "a" or "an" does not exclude a plurality. The mere fact that certain measures are recited in mutually different dependent claims does not indicate that a combination of these measures cannot be used to advantage.

What is claimed is:

1. A display apparatus comprising:

a plurality of pixel units arranged in an array, each of the plurality of pixel units comprising a respective common transistor and at least two respective sub-pixel circuits for displaying different colors, wherein the at least two respective sub-pixel circuits comprises a first sub-pixel circuit and a second sub-pixel circuit, the first sub-pixel circuit comprising:

a first organic light emitting diode having a first anode;

a first driving transistor connected in series with the first organic light emitting diode via the first anode; and a first sensing transistor having a first electrode connected to the first anode, a first gate connected to a first scan line, and a second electrode, the second sub-pixel circuit comprising:

a second organic light emitting diode having a second anode;

a second driving transistor connected in series with the second organic light emitting diode via the second anode; and a second sensing transistor having a third electrode connected to the second anode, a second gate connected to a first scan line, and a fourth electrode, wherein the common transistor comprises a fifth electrode, a gate connected to the first scan line, and a sixth electrode connected to a sensing line, the second electrode and the fourth electrode are both connected to the fifth electrode of the common transistor, and the second electrode and the fourth electrode are connected in parallel with each other.

2. The display apparatus of claim 1, wherein the at least two respective sub-pixel circuits are configured such that the first driving transistor or the second driving transistor generates a pixel current based on a data voltage upon supply of the data voltage to the first sub-pixel circuit or the second sub-pixel circuit in a compensation mode, and wherein the first sensing transistor or the second sensing transistor and the common transistor to which the data voltage is supplied are configured to transfer the generated pixel current to the sensing line for detection in response to a first scan signal from the first scan line in the compensation mode.

3. The display apparatus of claim 1, wherein the first sub-pixel circuit further comprises:

a first storage capacitor having a first terminal connected to a gate of the first driving transistor and a second terminal connected to a source of the first driving transistor; and a first switching transistor having a first electrode connected to the data line, a gate connected to a second scan line, and a second electrode connected to the first terminal of the first storage capacitor, and wherein the second sub-pixel circuit further comprises:

a second storage capacitor having a third terminal connected to a gate of the second driving transistor and a fourth terminal connected to a source of the second driving transistor; and a second switching transistor having a first electrode connected to the data line, a gate connected to a second scan line, and a second electrode connected to the third terminal of the second storage capacitor.

4. The display apparatus of claim 3, wherein each of the first driving transistor and the second driving transistor is an N-type transistor, and wherein the source of the first driving transistor and the second terminal of the first storage capacitor are connected to the first anode of the first organic light emitting diode, and the source of the second driving transistor and the fourth terminal of the second storage capacitor are connected to the second anode of the second organic light emitting diode.

5. The display apparatus of claim 4, wherein the first sensing transistor or the second sensing transistor and the common transistor are configured to transfer a reference voltage to the second terminal or the fourth terminal in response to the first scan signal from the first scan signal line upon application of the reference voltage to the sensing line.

6. The display apparatus of claim 3, wherein each of the first driving transistor and the second driving transistor is a P-type transistor, and wherein a drain of the first driving transistor and the second terminal of the first storage capacitor are connected to the first anode of the first organic light emitting diode, and the drain of the second driving transistor and the fourth terminal of the second storage capacitor are connected to the second anode of the second organic light emitting diode.

7. The display apparatus of claim 1, wherein the common transistor is a bottom-gate transistor.

8. A display apparatus comprising:

a first scan driver for sequentially supplying a first scan signal to a plurality of first scan lines;

a second scan driver for sequentially supplying a second scan signal to a plurality of second scan lines;

a data driver for generating data signals based on image data and supplying the generated data signals to a plurality of data lines;

a plurality of pixel units each comprising a respective common transistor and at least two respective sub-pixel circuits for displaying different colors, the plurality of pixel units being arranged in an array such that the sub-pixel circuits of the plurality of pixel units are arranged in rows and columns, each row of sub-pixel circuits being connected to a respective one of the plurality of first scan lines and a respective one of the plurality of second scan lines, each column of sub-pixel circuits being connected to a respective one of the plurality of data lines, wherein the at least two respective sub-pixel circuits comprises a first sub-pixel circuit and a second sub-pixel circuit, the first sub-pixel circuit comprising: a first organic light emitting diode having a first anode; a first driving transistor connected in series with the first organic light emitting diode via the first anode; and a first sensing transistor having a first electrode connected to the first anode, a first gate connected to a first scan line to which the row of sub-pixel circuits is connected, and a second electrode, the second sub-pixel circuit comprising: a second organic light emitting diode having a second anode; a second driving transistor connected in series with the second organic light emitting diode via the second anode; and a second sensing transistor having a third electrode connected to the second anode, a second gate connected to a first scan line to which the row of sub-pixel circuits is connected, and a fourth electrode, wherein the common transistor comprises a fifth electrode, a gate connected to the first scan line to which the row of sub-pixel circuits is connected, and a sixth electrode connected to the sensing line to which the column of pixel units is connected, the second electrode and the fourth electrode are both connected to the fifth electrode of the common transistor, and the second electrode and the fourth electrode are connected in parallel with each other, wherein each column of pixel units is connected to a respective one of the plurality of sensing lines;

a plurality of sampling circuits each connected to a respective one of the plurality of sensing lines, wherein each of the sampling circuits is configured to sample a voltage generated by the pixel current transferred by the respective sensing line charging a capacitance present on the sensing line; and a timing controller for controlling operations of the first scan driver, the second scan driver, the data driver, and the plurality of sampling circuits and compensating the image data provided to the data driver based on the sampling by the plurality of sampling circuits.

9. The display apparatus of claim 8, wherein each of the plurality of sampling circuits comprises a first controlled switch and an analog-to-digital converter, wherein:

the first controlled switch is configured to couple the generated voltage to the analog-to-digital converter in response to a first switch control signal; and the analog-to-digital converter is configured to convert the generated voltage into a digital value and provide the digital value to the timing controller.

10. The display apparatus of claim 9, wherein each of the first driving transistor and the second driving transistor is an N-type transistor, and wherein each of the plurality of sampling circuits further comprises a second controlled switch configured to apply a reference voltage supplied by a reference voltage source to the sensing line in response to a second switch control signal.

11. The display apparatus of claim 10, wherein the first sensing transistor and the second sensing transistor of the at least two respective sub-pixel circuits and the common transistor of each of the pixel units are configured to transfer the reference voltage to the first electrode and the third electrode in response to the first scan signal from the first scan line upon application of the reference voltage to the sensing line.

12. The display apparatus of claim 8, wherein the first sub-pixel circuit further comprises:

a first storage capacitor having a first terminal connected to a gate of the first driving transistor and a second terminal connected to a source of the first driving transistor; and a first switching transistor having a first electrode connected to the data line to which the column of sub-pixel circuits is connected, a gate connected to a second scan line to which the row of sub-pixel circuits is connected, and a second electrode connected to the first terminal of the first storage capacitor, and wherein the second sub-pixel circuit further comprises:

a second storage capacitor having a third terminal connected to a gate of the second driving transistor and a fourth terminal connected to a source of the second driving transistor; and a second switching transistor having a first electrode connected to the data line to which the column of sub-pixel circuits is connected, a gate connected to a second scan line to which the row of sub-pixel circuits is connected, and a second electrode connected to the third terminal of the second storage capacitor.

13. The display apparatus of claim 12, wherein each of the first driving transistor and the second driving transistor is an N-type transistor, and wherein the source of the first driving transistor and the second terminal of the first storage capacitor are connected to the first anode of the first organic light emitting diode, and the source of the second driving transistor and the fourth terminal of the second storage capacitor are connected to the second anode of the second organic light emitting diode.

14. The display apparatus of claim 12, wherein each of the first driving transistor and the second driving transistor is a P-type transistor, and wherein a drain of the first driving transistor and the second terminal of the first storage capacitor are connected to the first anode of the first organic light emitting diode, and the drain of the second driving transistor and the fourth terminal of the second storage capacitor are connected to the second anode of the second organic light emitting diode.

15. The display apparatus of claim 8, wherein the common transistor is a bottom-gate type transistor.

16. A method of driving a display apparatus, the display apparatus comprising a plurality of pixel units arranged in an array, each of the plurality of pixel units comprising a respective common transistor and at least two respective sub-pixel circuits for displaying different color components, the at least two respective sub-pixel circuits comprises a first sub-pixel circuit and a second sub-pixel circuit, the first sub-pixel circuit comprising: a first organic light emitting diode having a first anode; a first driving transistor connected in series with the first organic light emitting diode via the first anode; and a first sensing transistor having a first electrode connected to the first anode, a first gate connected to a first scan line to which the row of sub-pixel circuits is connected, and a second electrode; a first storage capacitor having a first terminal connected to a gate of the first driving transistor and a second terminal connected to a source of the first driving transistor; and a first switching transistor having a first electrode connected to the data line, a gate connected to a second scan line, and a second electrode connected to the first terminal of the first storage capacitor, the second sub-pixel circuit comprising: a second organic light emitting diode having a second anode; a second driving transistor connected in series with the second organic light emitting diode via the second anode; and a second sensing transistor having a third electrode connected to the second anode, a second gate connected to a first scan line to which the row of sub-pixel circuits is connected, and a fourth electrode; a second storage capacitor having a third terminal connected to a gate of the second driving transistor and a fourth terminal connected to a source of the second driving transistor; and a second switching transistor having a first electrode connected to the data line, a gate connected to a second scan line, and a second electrode connected to the third terminal of the second storage capacitor, wherein the common transistor comprises a fifth electrode, a gate connected to the first scan line to which the row of sub-pixel circuits is connected, and a sixth electrode connected to the sensing line to which the column of pixel units is connected, the second electrode and the fourth electrode are both connected to the fifth electrode of the common transistor, and the second electrode and the fourth electrode are connected in parallel with each other, the method comprising:

simultaneously with supplying a data signal to one of respective data lines connected to the at least two respective sub-pixel circuits, applying a second scan signal from the second scan line to the gates of the first switching transistor or the second switching transistor so as to transfer the data signal from the data line to the first terminal of the first storage capacitor or the third terminal of the second storage capacitor to which the data line is connected;

transferring a pixel current generated by the first driving transistor or the second driving transistor based on the data signal to the sense line by applying a first scan signal from the first scan line to the gates of the first sensing transistor or the second sensing transistor and the gate of the common transistor, wherein the pixel current charges a capacitance present on the sense line; and transferring via the sensing line a voltage generated by the pixel current charging the capacitance to an external circuit for detection.

17. The method of claim 16, wherein each of the first driving transistor and the second driving transistor is an N-type transistor, wherein the source of the first driving transistor and the second terminal of the first storage capacitor are connected to the first anode of the first organic light emitting diode, the source of the second driving transistor and the fourth of the second storage capacitor are connected to the second anode of the second organic light emitting diode, and wherein the method further comprises simultaneously with applying the second scan signal to the gates of the first switching transistor and the second switching transistor, transferring a reference voltage applied to the sensing line to the second terminal of the first storage capacitor or the fourth terminal of the second storage capacitor by applying the first scan signal to the gate of the first sensing transistor or the gate of the second sensing transistor and the gate of the common transistor.

18. The method of claim 16, further comprising simultaneously with transferring the pixel current to the sensing line, deactivating the second scan signal to turn off the switching transistor.

19. The method of claim 16, further comprising simultaneously with transferring the pixel current to the sensing line, maintaining the second scan signal active to continuously apply the data signal to the first terminal of the first storage capacitor or the third of the second storage capacitor.

20. The method of claim 16, wherein the common transistor is a bottom-gate transistor.

* * * * *